United States Patent [19]

Jalonen

[11] 4,240,078

[45] Dec. 16, 1980

[54] FREQUENCY SELECTIVE ANNUNCIATOR SYSTEM

[75] Inventor: Donald A. Jalonen, White Bear Lake, Minn.

[73] Assignee: Minnesota Mining and Manufacturing Company, Saint Paul, Minn.

[21] Appl. No.: 913,288

[22] Filed: Jun. 7, 1978

[51] Int. Cl.[3] ..... G08B 25/00

[52] U.S. Cl. ..... 340/524; 340/533; 340/658

[58] Field of Search ..... 340/533, 524, 658, 506

[56] References Cited

U.S. PATENT DOCUMENTS

| | | | |
|---|---|---|---|
| 3,626,316 | 12/1971 | Connell, Jr. | 331/56 |
| 3,710,372 | 1/1973 | Andersson et al. | 340/533 |
| 3,760,359 | 9/1973 | McQuown, Jr. | 340/533 |

*Primary Examiner*—Glen R. Swann, III

*Attorney, Agent, or Firm*—Cruzan Alexander; Donald M. Sell; William D. Bauer

[57] ABSTRACT

The supervised conductive loop comprises a plurality of switch elements connected in series with a DC current source. Encoder modules are located in parallel with each of the switch elements. The encoder module comprises an oscillator and an impedance element. When a switch element is opened, the oscillator associated with that switch is energized and places an AC signal on the loop. The frequency of each oscillator uniquely identifies the associated switch element. The impedance element, formed by a resistor and a capacitor, is used both as a filter for the power supply voltage to the oscillator as well as a bandpass filter to permit oscillator signals present on the loop to bypass open switch elements and be detected at any location in the loop. Frequency identifying means are coupled to the loop to permit an indication of which oscillators have been operated.

3 Claims, 3 Drawing Figures

FREQUENCY SELECTIVE ANNUNCIATOR SYSTEM

BACKGROUND OF THE INVENTION

1. Field of the Invention

This invention relates to an electronic annunciator system which is used to monitor a conductive loop which has a number of switch elements and a DC power source in series. More particularly, the invention relates to an encoder module which may be placed in parallel with each switch element to permit a remote identification of which switch elements have been activated in the monitored loop.

2. Description of the Prior Art

Conventional prior art security systems comprise a conductive loop which has a plurality of switch elements and a DC power source in series in the loop. The switch elements may be formed as frangible metal strips or other switching devices which are activated by a selected event. The switch elements may be activated by an intruder who is attempting to enter the protected premises or the switch elements may be temperature-activated to protect a premises from fire. In conventional systems, the interruption or opening of a switch element reduces the current flowing in the loop to zero which actuates a relay which sends an alarm signal over conventional telephone lines to a remote central office receiving station. These prior art systems may also actuate an alarm system on the premises protected by the security system. The principal defect of such alarm systems is that they do not permit a remote or on-site identification of which of the several possible switch elements has been opened.

An advance over this prior art is disclosed in U.S. Pat. No. 3,760,359 to McQuown. In the McQuown system, an impedance element such as a resistor is located in series with each switch device. Electronic circuitry is provided which measures the current flow through the circuit. Any attempt by an intruder to bypass this impedance element will result in either an increase or decrease in the supervisory current. Electronic circuitry which detects this change in current in the loop is used to initiate the operation of an oscillator which, when energized, places a signal on the alarm loop. The principal disadvantage of the McQuown invention is that only one oscillator at a time may be activated. Consequently, this prior art system cannot be used to indicate multiple intrusions or multiple switch openings.

SUMMARY OF THE INVENTION

Applicant's invention provides a method by which simultaneous multiple switch openings can be detected and announced on-site. The applicant provides an encoder module which may be attached in parallel with the switch elements of a conventional security system without interfering with the use of the switch elements in a conventional alarm signalling system. The encoder module contains an oscillator and an impedance element which are used in conjunction with the existing normally closed switch element in the conventional alarm loop. The oscillator element is used to generate an AC signal which uniquely identifies the particular switch element which is associated with that oscillator. The impedance element is used both as a power supply filter in the power supply of the oscillator as well as a bandpass filter to permit oscillator signals coupled to the alarm loop to bypass the open switch elements.

In operation, the normally closed switch element permits the supervisory current generated by a DC power source to circulate around the loop. When the switch element is opened, the potential of the alarm loop is present across the open switch element. The polarity of the DC power source which generates the supervisory current defines a positive side and a negative side for the opened switch element. The encoder module provides an impedance element which is connected in parallel with this open switch element. The impedance element is formed by the series connection of a resistor and a capacitor. The resistor of the impedance element is connected to the positive side of the switch element while the capacitor is connected to the negative side of the switch element. When the switch element is opened, the series resistor-capacitor impedance element connected in parallel with the switch provides a bandpass filter which permits AC signals coupled to the alarm loop to bypass this open switch element and be detected anywhere on the loop.

The oscillator which generates the frequency identifying signal has both a positive power supply lead and a negative power supply lead. The positive supply lead of the oscillator is connected at the junction between the resistor and capacitor of the impedance means, while the negative supply lead is connected to the negative side of the switch element. When the switch element is opened, the potential of the DC power source is present across the power supply leads of the oscillator which energizes the oscillator. These power supply connections with the impedance element act to reduce the voltage variations present on the loop and thus provides a stable power supply for the oscillator.

The output of the oscillator is coupled to the loop through a coupling resistor. The coupling resistor determines the peak-to-peak variations of the oscillator signal which is present on the loop. The values of the resistor and capacitor in the impedance element are selected to provide both the bandpass feature as well as the power supply filtering feature. Since the magnitude of the passive components of the impedance element as well as the coupling resistor of the oscillator affect the peak-to-peak voltage variation of the oscillator signal present on the loop, these components must be considered together when selecting component values. Correct selection of these component values permits the oscillators to transmit their output signal along the loop, which also forms their power supply without interfering with the stable operation of the oscillator itself.

Although the invention is particularly useful in security systems such as burglar or fire alarms, the ability to detect switch openings is also useful in a number of process control situations. For example, temperature-actuated switches may be monitored by such an annunciator system to indicate the failure of an individual refrigeration unit in a process control situation.

DESCRIPTION OF THE PREFERRED EMBODIMENTS

Figure 1:
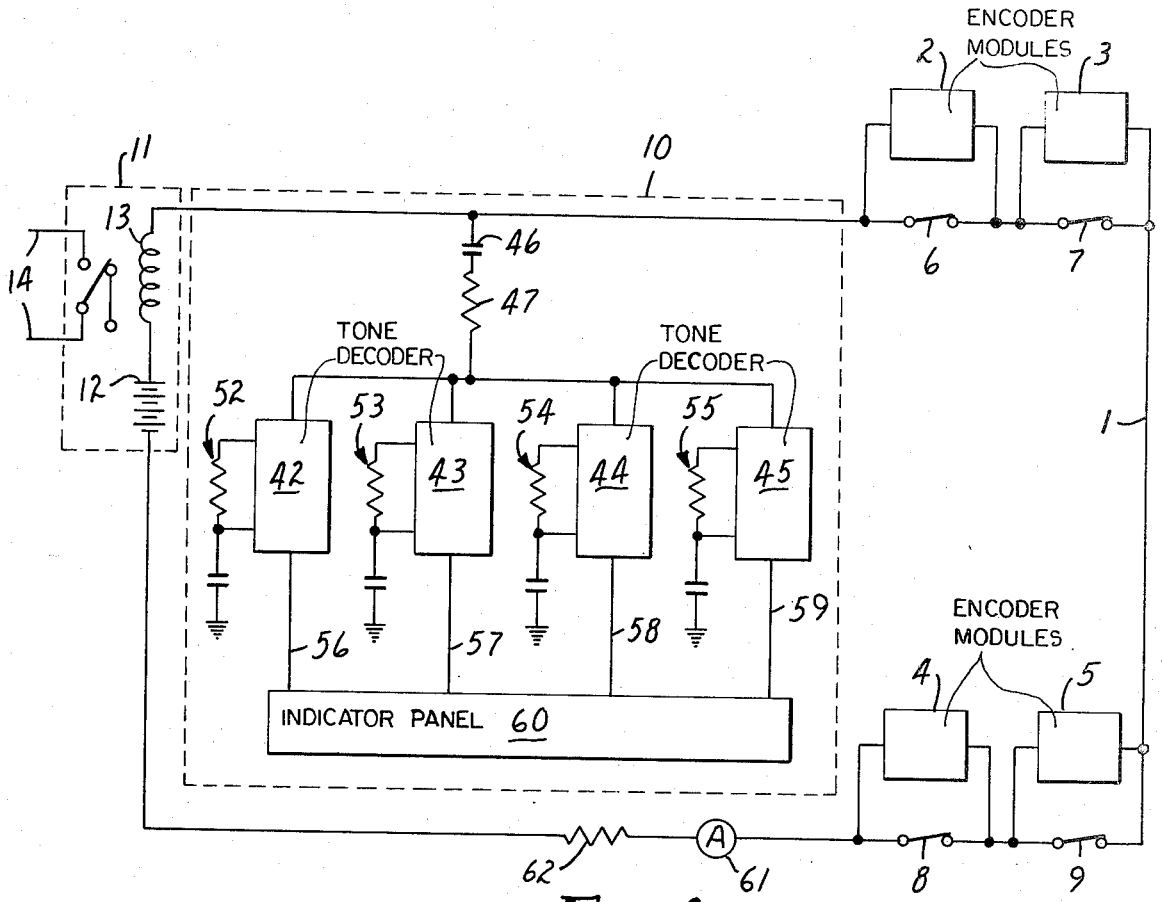
FIG. 1 shows the schematic arrangement of applicant's encoder modules and decoder devices attached to a conventional alarm system.

FIG. 1 shows a plurality of switch elements 6, 7, 8 and 9 in series with a conductive wire loop 1. A plurality of encoder modules designated 2, 3, 4 and 5 are connected in parallel with each of these switch elements. A remote annunciator panel 10 containing frequency decoding devices is coupled to the loop 1 for indicating which of the several oscillators has been actuated. The loop 1 is coupled to a conventional alarm sensing equipment 11. The conventional alarm sensing equipment may contain a DC power source indicated by battery 12 and a relay 13. In a typical security loop system, the power source 12 will generate a voltage of approximately 12 volts and place a supervisory current of approximately 6 milliamps on the loop 1. Activation of any switch element 6, 7, 8 or 9 will drop the supervisory current and actuate relay 13 which sends an alarm signal to a remote central location over lines 14.

Figure 2:
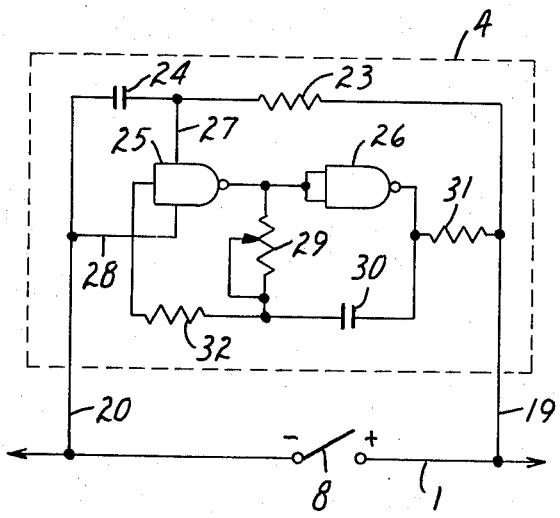
FIG. 2 is a schematic diagram of applicant's encoder module.

In FIG. 2, a schematic diagram of a typical encoder module such as the module 4 is shown. A switch element 8 is shown in series with a segment of the supervised loop 1. The polarity of the power source associated with the loop defines a positive side and a negative side of the switch element which is shown as a plus and minus sign in the figure. The encoder module is connected in parallel with the switch element 8 by means of leads 19 and 20. The impedance element is formed by capacitor 24 and resistor 23 which are in series with respect to each other in the encoder module and are connected in parallel with respect to the switch element 8 via lines 19 and 20.

The oscillator device is formed by a pair of NAND gates 25 and 26 which are wired as inverters and form an astable multivibrator. Capacitor 30 and variable resistor 29 form the timing element of the multivibrator and determine the output frequency of the oscillator. Resistor element 32 should have approximately twice the value of resistor 29 and is used to help stabilize the frequency of the oscillator. The oscillator has a positive voltage supply lead 27 which is connected at the junction of the resistor and capacitor of the impedance element. The negative supply lead of the oscillator 28 is connected to the negative side of the switch through lead 28.

In operation, when switch element 8 is closed, the supervisory DC current is shunted by the closed switch element 8 around the loop 1. When the switch element 8 is opened, the power supply potential of the generating source 12 is present across the power supply leads 27 and 28 of the oscillator which energizes it. The output of the oscillator is resistively coupled through resistor 31 to the loop 1. When switch elements are opened within the loop, oscillator signals coupled to the loop bypass open switch elements by means of the bandpass filters formed by the impedance element within each encoder module. This feature permits the signal of any oscillator coupled to the loop 1 to pass around any oscillator unit which is activated and permits the simultaneous detection of multiple switch openings in the loop.

The astable multivibrator which acts as the oscillator within the encoder to generate the identifying frequencies is shown as being formed by a pair of NAND gates which are wired as digital inverters. It is preferred that the multivibrator oscillator be implemented with complementary symmetry metal oxide semiconductor logic elements (CMOS), although any pair of inverting gates within this logic family can be used to form the multivibrator. CMOS logic is preferred because the current draw of the CMOS astable multivibrator is low when compared to other logic families such as transistor-transistor logic (TTL). This permits the applicant's invention to be used in conventional security loop systems where only six milliamps of supervisory current is available to power oscillators. It has also been found that CMOS logic is relatively insensitive to variations in power supply voltage levels and will operate reliably at voltages ranging from 3 to 15 volts.

Figure 3:
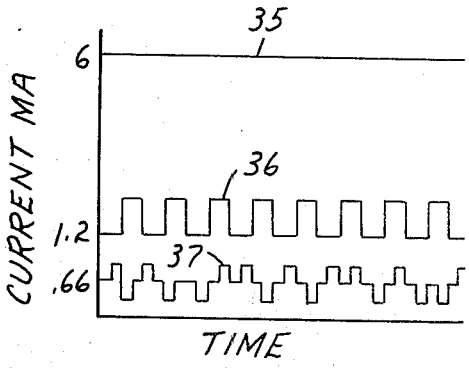
FIG. 3 is a graphic illustration of the current waveforms on the loop at various stages of operation.

FIG. 3 shows the current waveforms on the loop 1 as would be displayed by an ammeter 61 (FIG. 1) located in series with the loop, during the operation of applicant's invention. Trace 35 represents the 6 milliamp supervisory current present on the loop when all of the series switch elements in the loop are closed. When one switch element opens, activating an encoder module, the average current level on the loop drops to a new level, which is sufficient to ensure the actuation of the drop-out relay 13 which sends a signal to the central office, indicating the actuation of a switch element. Superimposed on this lower DC current is an oscillating AC signal 36. The magnitude of the current variation is determined by the selection of coupling resistor 31 as well as the magnitude of resistor 23 in the impedance element.

If a second encoder module is energized by the activation of another series switch element within the loop, the composite signal on the loop will appear as trace 37 in FIG. 3. The actuation of this subsequent oscillator or encoder causes a further drop in the average DC current level in the loop and the composite signal on the loop has a smaller peak-to-peak current variation. The complex waveform 37 results from a multiplicity of oscillators operating in an asynchronous fashion. This complex waveform results from the algebraic addition and subtraction of the signals present on the line. However, detector means which are associated with the loop decode this composite frequency signal and are capable of detecting the fundamental frequencies present in the complex waveform.

Although any one of a number of frequency detection schemes could be used to respond to the individual frequencies of oscillators which have been coupled to the alarm loop, the applicant has found that phase lock loop integrated circuits may be advantageously used to decode and detect the output of the various oscillator elements. A plurality of phase lock loop tone decoders designated 42, 43, 44 and 45 in FIG. 1 are coupled through a bandpass filter formed by the series connection of a capacitor 46 and a resistor 47 to the alarm loop.

Each tone decoder has associated with it an RC tuned circuit designated 52, 53, 54 and 55, each of which sets the center frequency of detection for the phase lock loop tone decoder. Each of the tone decoders are tuned to be responsive to one of the encoder module oscillators. Whenever the oscillator frequency is present at the input of the tone decoder, the tone decoder will generate an output signal indicative of this condition. The outputs of the tone decoders are coupled by leads 56, 57, 58 and 59 to a suitable indicating means 60, which may provide audible or visual indication of which switch elements have been tripped. This indicating means 60 may also have appropriate latching devices included therein to indicate which switch elements have been activated even if that switch element is subsequently closed. In this fashion, switch element openings are announced at an on-site location and provides an indication of which switch elements have been opened.

I claim:

1. An electronic annunciator system comprising a conductive loop having a plurality of switch elements in series in said loop, said switch elements being openable upon the occurrence of a selected event, a D.C. power source for generating a supervisory voltage and supervisory current in said loop, the polarity of said power source defining a positive side and a negative side for an opened switch element, a plurality of oscillators, one associated with each switch element, each generating individual identifying A.C. signals and having a positive supply lead, a negative supply lead and an output signal lead, said signal lead being connected to said loop through a resistor, a plurality of impedance means comprising a resistor and capacitor which are connected in series, each of said impedance means being connected in parallel with an associated one of said switch elements such that the capacitor is connected to said negative side and said resistor is connected to said positive side of said switch element for providing a bandpass filter permitting said A.C. signals from a said oscillator to bypass open switch elements, said positive supply lead of each oscillator being connected at the junction of the resistor and capacitor of an associated one of said impedance means and said negative supply lead being connected to said negative side of said associated switch element such that opening of said switch element energizes said oscillator and said impedance means acts as a power supply filter to stabilize the loop voltage and current used by said oscillators, and frequency decoder means coupled to said loop, responsive to the frequency identifying signals of said oscillators for individually indicating the operation of said oscillators.

2. The system of claim 1, wherein said oscillators are astable multivibrators formed from complementary symmetry metal oxide semiconductor inverting gates.

3. The system of claim 1, wherein said frequency decoding means comprise a plurality of phase lock loop tone decoders, each of said decoders tuned to a corresponding one of said oscillator individual identifying AC signals and having an output which is responsive to said corresponding identifying AC signal and is connected to suitable indicator means.

* * * * *